US012560032B2

(12) United States Patent
Bishop

(10) Patent No.: US 12,560,032 B2
(45) Date of Patent: Feb. 24, 2026

(54) RETAINING RING, METHOD, AND SYSTEM

(71) Applicant: Baker Hughes Oilfield Operations LLC, Houston, TX (US)

(72) Inventor: David Bishop, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/436,542

(22) Filed: Feb. 8, 2024

(65) Prior Publication Data

US 2025/0257615 A1 Aug. 14, 2025

(51) Int. Cl.
*E21B 17/06* (2006.01)
*E21B 23/00* (2006.01)

(52) U.S. Cl.
CPC ..... *E21B 17/06* (2013.01); *E21B 23/00* (2013.01)

(58) Field of Classification Search
CPC ..... E21B 17/06; E21B 23/00
See application file for complete search history.

(56) References Cited

U.S. PATENT DOCUMENTS 300,286 A * 6/1884 Salisbury ..... A44C 5/12 224/174
7,607,476 B2 * 10/2009 Tom ..... E21B 43/106 166/380
2003/0019624 A1 * 1/2003 Davis ..... E21B 17/105 166/241.6
2018/0106127 A1 4/2018 Du et al.
2018/0305985 A1 * 10/2018 Steine ..... E21B 17/1078

FOREIGN PATENT DOCUMENTS

GB 2579916 A 7/2020

OTHER PUBLICATIONS

Notification of Transmittal of the International Search Report and the Written Opinion of the International Searching Authority, or the Declaration; PCT/2025/014266; Mail date: Apr. 2, 2025; 13 pages.

* cited by examiner

*Primary Examiner* — Robert E Fuller
(74) *Attorney, Agent, or Firm* — Baker Hughes Patent Organization

(57) ABSTRACT

A retaining ring, including a body, a first end extending from the body, and a second end extending from the body, the second end engageable with the first end and releasable from the first end at a threshold energy input. A collet release configuration including a collet having a shoulder thereon, a ring disposed radially adjacent the collet, a sleeve actuable by movement of the collet only with the ring unreleased. A method for actuating a tool, including deflecting a collet, loading a ring, with the collet against a structure of the tool, actuating the tool with the ring, releasing the ring, and deflecting the collet. A borehole system, including a borehole in a subsurface formation, a string in the borehole, and a retaining ring, disposed within or as a part of the string.

15 Claims, 7 Drawing Sheets

RETAINING RING, METHOD, AND SYSTEM

BACKGROUND

In the resource recovery and fluid sequestration industries actuation of tools is a ubiquitous endeavor. Often multiple functions with a single movement direction of a tool member would be desirable is it could be made possible. Making such activity possible often requires stiffer tools that require higher forces to pull or push them into a different position. While that method can work, the art would appreciate alternatives.

SUMMARY

An embodiment of a retaining ring, including a body, a first end extending from the body, and a second end extending from the body, the second end engageable with the first end and releasable from the first end at a threshold energy input.

An embodiment of a collet release configuration including a collet having a shoulder thereon, a ring disposed radially adjacent the collet, a sleeve actuable by movement of the collet only with the ring unreleased.

An embodiment of a method for actuating a tool, including deflecting a collet, loading a ring, with the collet against a structure of the tool, actuating the tool with the ring, releasing the ring, and deflecting the collet.

An embodiment of a borehole system, including a borehole in a subsurface formation, a string in the borehole, and a retaining ring, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
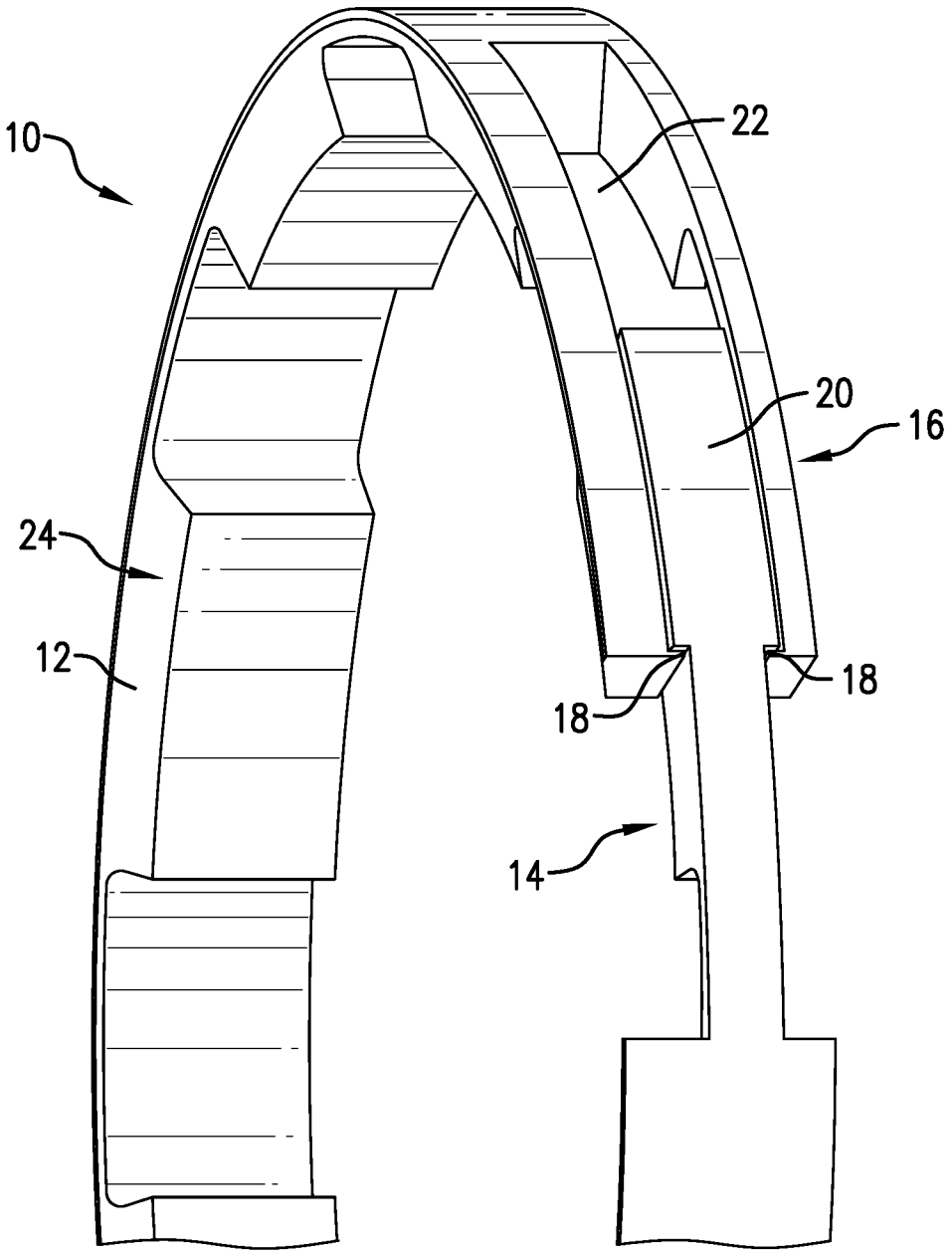
FIG. 1 is a retaining ring as disclosed herein.
Figure 2:
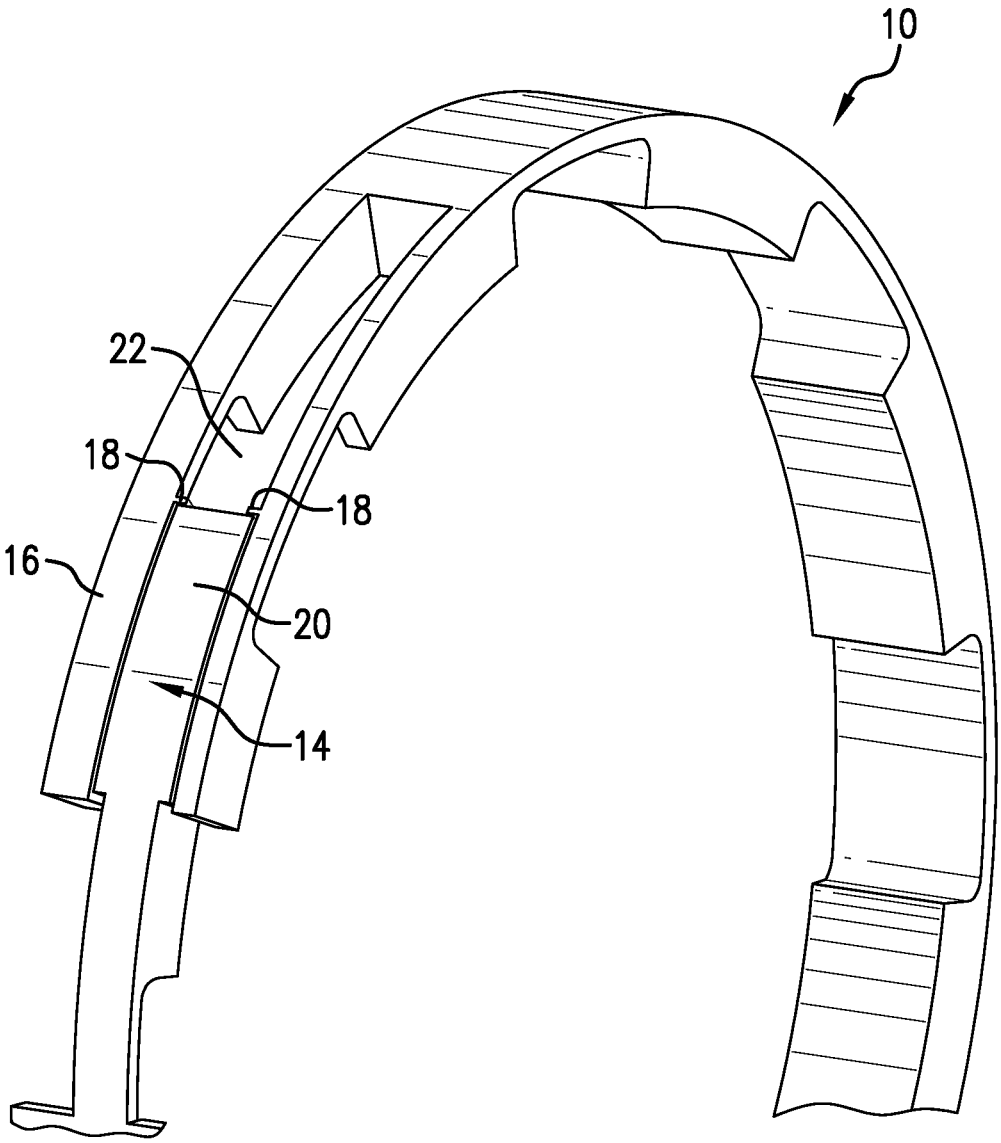
FIG. 2 is an alternate embodiment of the retaining ring as disclosed herein.

Referring to FIG. 1, a first embodiment of a retaining ring 10 is illustrated. The ring comprises a body 12 having a first end 14 and a second end 16. The second end 16 includes a flange 18 (one or more), while the first end comprises a head 20. In an embodiment, the second end 16 comprises a fork structure. It will be appreciated that the second end 16 provides space 22 for the first end 14 to move into with sufficient energy applied. The applied energy is generally that generated by a human hand squeezing the ring or pulling on the ring for installation or a machine designed to apply the same energy to install the ring 10. This energy results in the diameter of the ring 10 being made temporarily smaller (for FIG. 1), which facilities the insertion of the ring 10 into an inside surface gland or similar. Referring to FIG. 2, the flanges 18 are in a different position and it will be appreciated that the diameter of the ring 10 may be made temporarily larger to snap into an outside diameter groove in a component. In the opposite direction to that just described, i.e., to a larger diameter for FIG. 1 and a smaller diameter for FIG. 2, the diameters may not change without first applying a threshold energy that is sufficient to cause a release of the ring 10 pursuant to failure of the flange(s) 18. In one embodiment the failure of the flange(s) 18 is by shearing. In some embodiments, a face 24 of the ring may be frustoconically shaped although other embodiments may have an orthogonal face.

Figure 3:
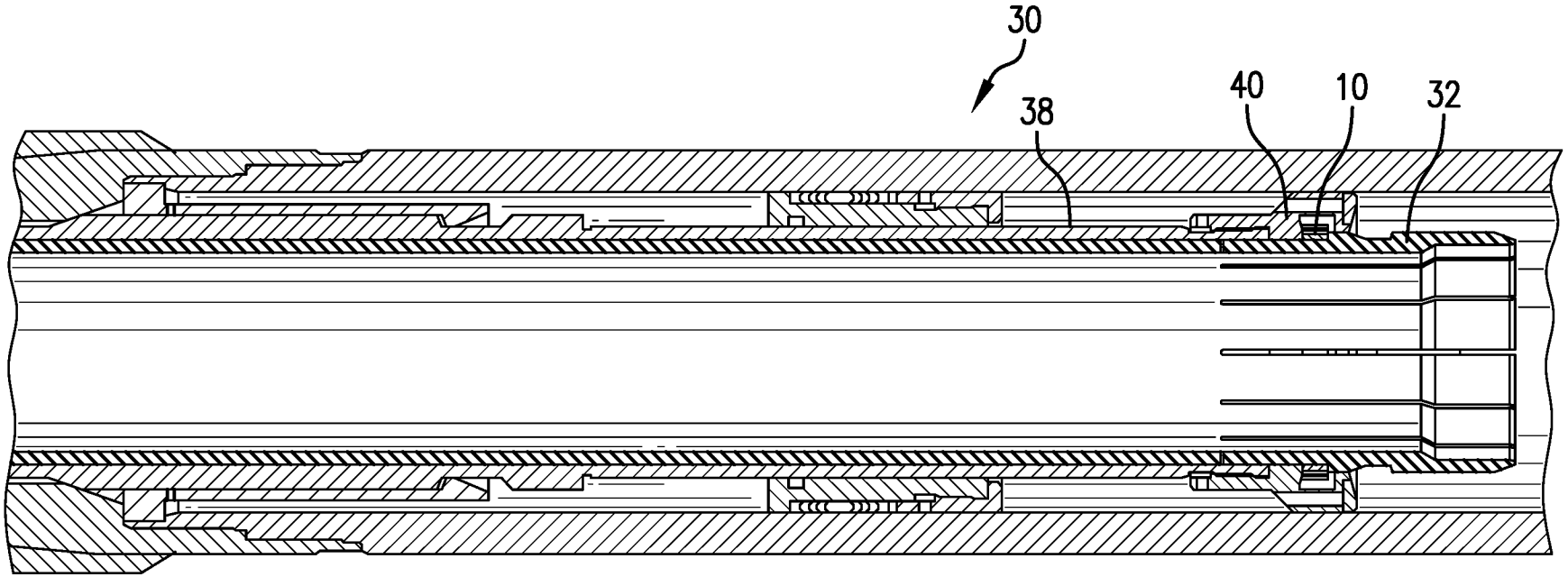
FIG. 3 is a sectional view of a tool that employs the ring of FIG. 1 or 2.
Figure 4:
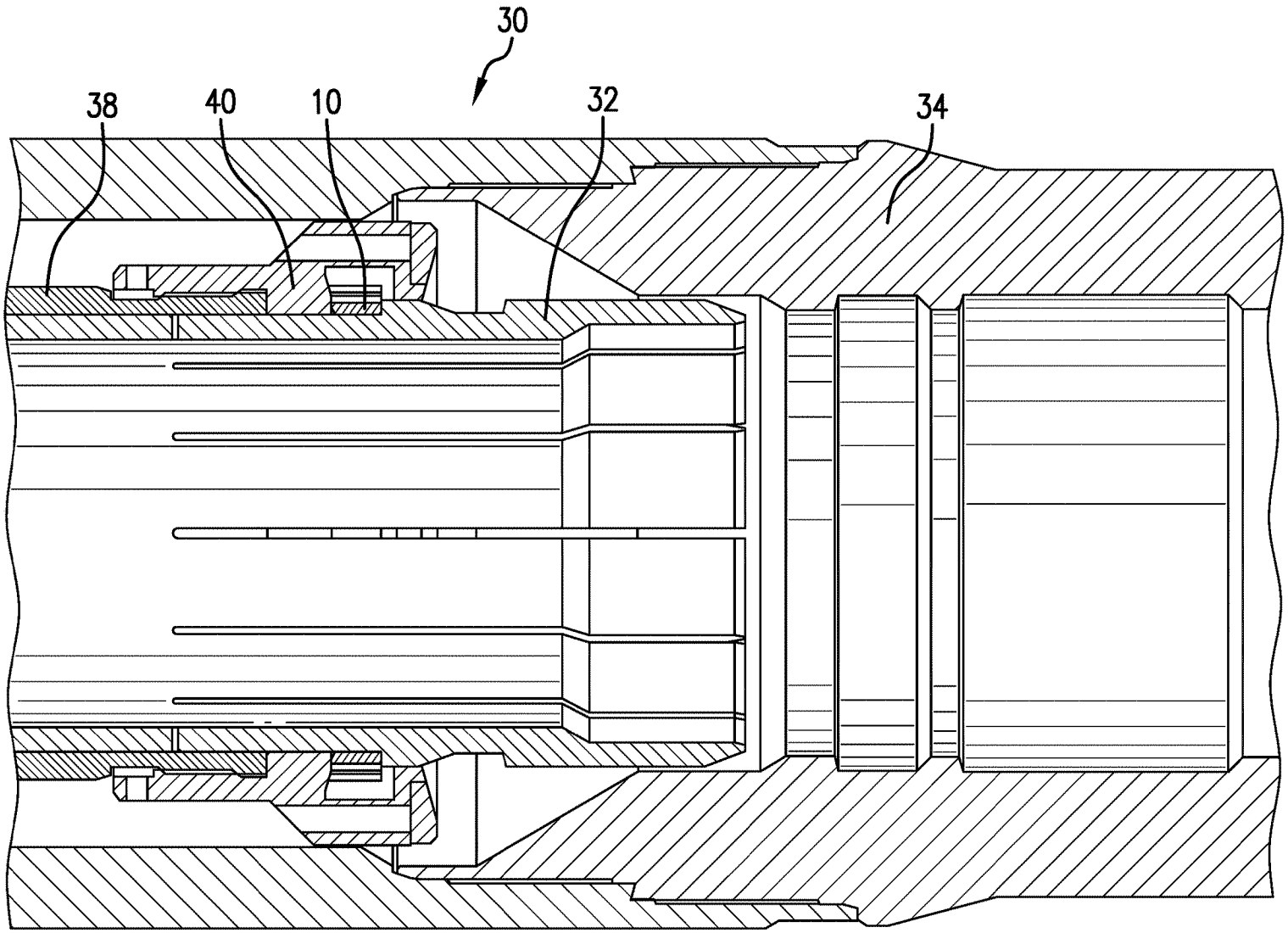
FIG. 4 is an enlarged view of a portion of FIG. 3.
Figure 5:
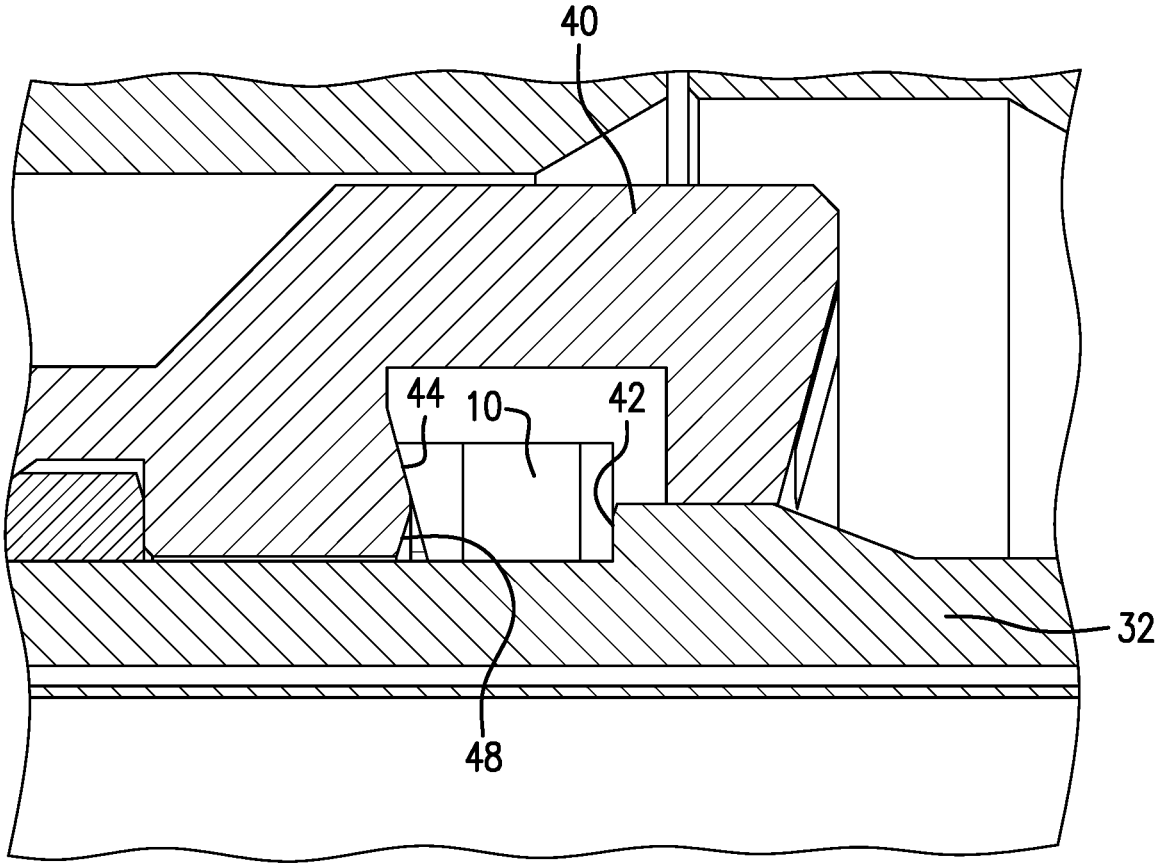
FIG. 5 is an enlarged view of a portion of FIG. 4, illustrating interaction of the ring with other components.
Figure 6:
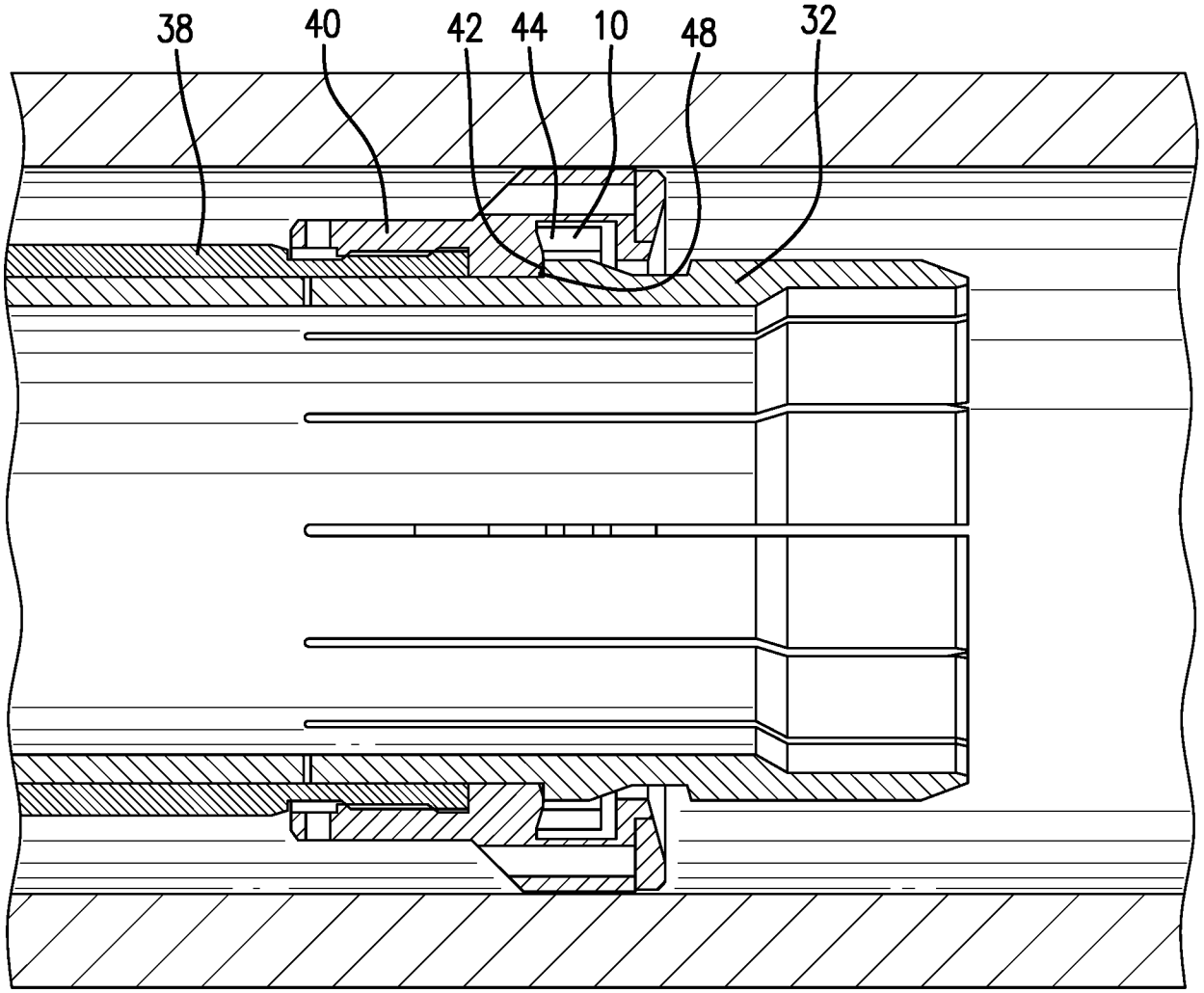
FIG. 6 is a view similar to FIG. 5 with the ring shown with an expanded diameter after release of the ring.

Referring to FIGS. 3-6, the ring as illustrated in FIGS. 1 and 2 is illustrated in situ within a tool that provides greater understanding of the function and value of the ring 10. Referring to FIGS. 3 and 4 components of a tool 30 are introduced. Tool 30 includes a collet 32 configured to engage a profile 34. The collet 32 is in an embodiment a relatively low force deflection rating, such as about 100-about 500 pounds axial force, which allows for disengagement of the profile 34 without a significant tensile load being applied. This is desirable for efficiency and for reasons relative to other tools in the well, but it also presents a problem for a tool configured similarly to tool 30 where the collet 32 is also intended to actuate something other than the engagement of the profile 34. In this case the example of something being actuated is a sleeve 38. In the example, the collet 32 is not strong enough to actuate the sleeve 38 before it would deform and release the sleeve 38. The sleeve 38 includes an adapter 40 that works in conjunction with the ring 10. The actuation load is transmitted from the collet 32, which is placed in tension from an uphole position (e.g. pulling of the string above from the rig) through the ring 10 to the adapter 40 and to the sleeve 38 which allows for a full stroking of the sleeve 38 prior to the collet 32 deflecting and being retrieved form the hole. Referring to FIG. 5, a better understanding of the operation of the ring can be appreciated. Ring 10 initially is loaded from the collet 32 through shoulder 42 and passes that load to the adapter 40 on load surface 44. That load is directly translated to sleeve 38. The ring 10 as described above resists expanding (or contracting, in the illustrated embodiment, the action is expanding) until the threshold energy input is provided. That energy is provided by the angle of load surface 44 and may be assisted in some embodiments where the ring has a frustoconical face 24. Axially directed load through ring 10, will be reacted into a radially expansive moment in the ring 10. When that radially expansive moment causes the load on the flanges 18 to exceed the threshold amount, the flanges let go and the head 20 is able to move out of the fork of the second end 16, thereby allowing the ring 10 to assume a larger diameter. The ring hence climbs the surface 44, which is illustrated in FIG. 6. The shoulder 42 then will move under the ring 10 and contact a deflection surface 48, whereby the collet 32 is urged to deflect and slide out of the adapter 40. Because of the ring 10, the deflection rating of the collet can be lower while still ensuring the sleeve 38 or other component can be fully actuated.

Figure 7:
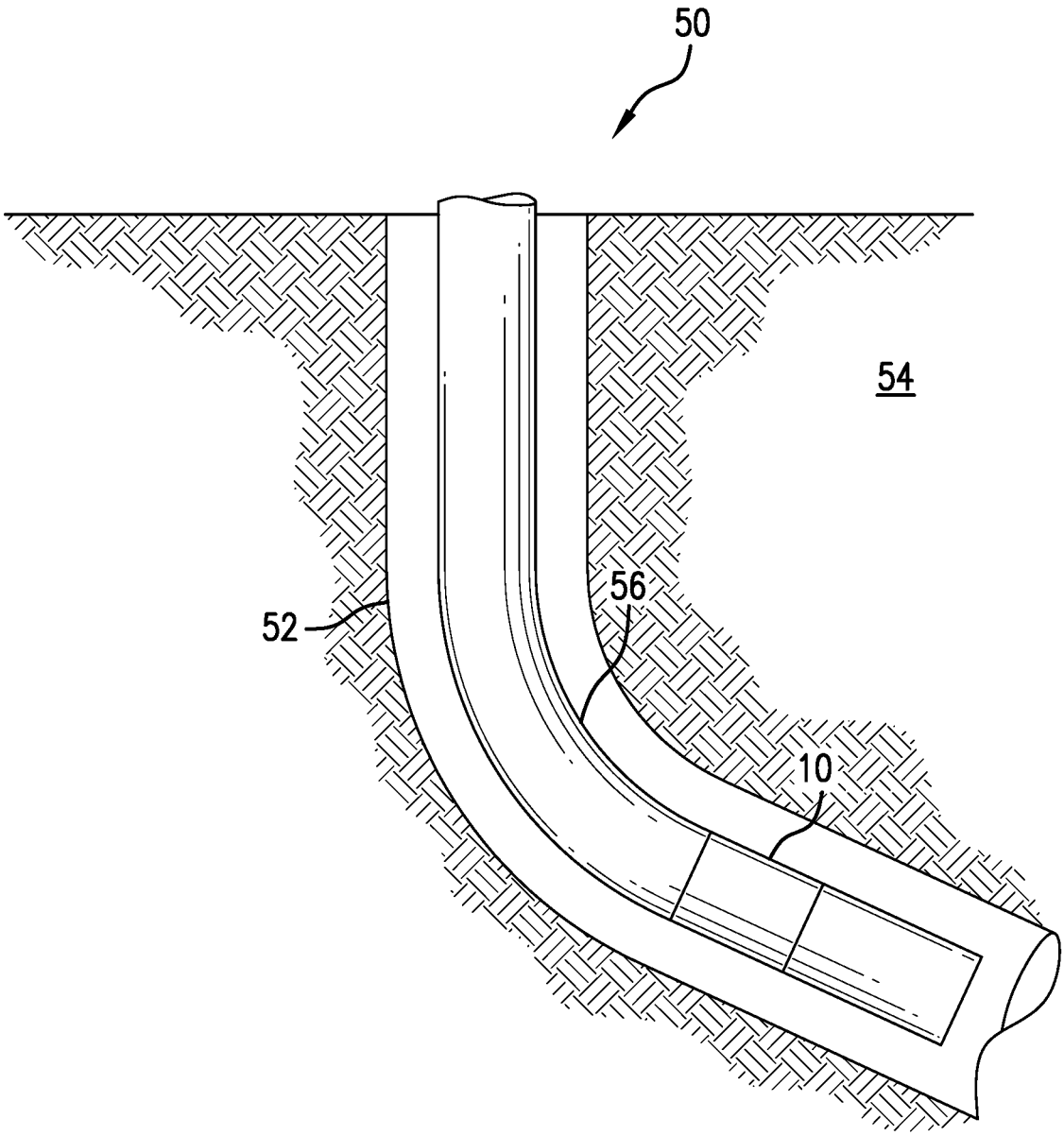
FIG. 7 is a view of a borehole system including a retaining ring as disclosed herein.

Referring to FIG. 7, a borehole system 50 is illustrated. The system 50 comprises a borehole 52 in a subsurface formation 54. A string 56 is disposed within the borehole 52. A retaining ring 10 as disclosed herein is disposed within or as a part of the string 56.

Set forth below are some embodiments of the foregoing disclosure:

Embodiment 1: A retaining ring, including a body, a first end extending from the body, and a second end extending from the body, the second end engageable with the first end and releasable from the first end at a threshold energy input.

Embodiment 2: The ring as in any prior embodiment, wherein the first end includes a head.

Embodiment 3: The ring as in any prior embodiment, wherein second end includes a receptacle.

Embodiment 4: The ring as in any prior embodiment, wherein the second end is configured as a fork.

Embodiment 5: The ring as in any prior embodiment, wherein the second end includes a release flange engaged with the first end.

Embodiment 6: The ring as in any prior embodiment, wherein the release flange is shearable at the threshold energy input.

Embodiment 7: The ring as in any prior embodiment, wherein the release flange is at a terminus of the second end.

Embodiment 8: The ring as in any prior embodiment, wherein the release flange is disposed spaced from the terminus of the second end.

Embodiment 9: The ring as in any prior embodiment, wherein the ring is configured to flexibly be deflectable to a smaller diameter and only after release be deflectable to a larger diameter.

Embodiment 10: The ring as in any prior embodiment, wherein the ring is configured to flexibly be deflectable to a larger diameter and only after release be deflectable to a smaller diameter.

Embodiment 11: A collet release configuration including a collet having a shoulder thereon, a ring as in any prior embodiment, disposed radially adjacent the collet, a sleeve actuable by movement of the collet only with the ring unreleased.

Embodiment 12: A method for actuating a tool, including deflecting a collet, loading a ring as in any prior embodiment, with the collet against a structure of the tool, actuating the tool with the ring, releasing the ring, and deflecting the collet.

Embodiment 13: The method as in any prior embodiment, wherein the releasing includes achieving a threshold load on the ring.

Embodiment 14: The method as in any prior embodiment, wherein the releasing includes shearing a flange.

Embodiment 15: The method as in any prior embodiment, wherein after the releasing the method includes changing a diameter of the ring.

Embodiment 16: The method as in any prior embodiment, wherein the method further includes disposing the ring radially adjacent the collet by deflecting the ring to a smaller diameter if the ring is to be radially inwardly disposed of the collet and deflecting the ring radially outwardly if the ring is to be radially outwardly disposed of the collet.

Embodiment 17: A borehole system, including a borehole in a subsurface formation, a string in the borehole, and a retaining ring as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A retaining ring, comprising:

a body having a radially inwardly located circumferentially extending face, a radially outwardly located circumferentially extending face and a frustoconical axial face extending from the radially inwardly located circumferentially extending face to the radially outwardly located circumferentially extending face;

a first end extending from the body; and a second end having a fork structure extending from the body and wherein tines of the fork structure point in a circumferential direction and are axially spaced from one another to define a receptacle, the second end engageable with the first end and releasable circumferentially from the first end at a threshold energy input.

2. The ring as claimed in claim 1, wherein the first end includes a head.

3. The ring as claimed in claim 1, wherein the second end includes a release flange engaged with the first end.

4. The ring as claimed in claim 3, wherein the release flange is shearable at the threshold energy input.

5. The ring as claimed in claim 3, wherein the release flange is at a terminus of the second end.

6. The ring as claimed in claim 3, wherein the release flange is disposed spaced from the terminus of the second end.

7. The ring as claimed in claim 1, wherein the ring is configured to flexibly be deflectable to a smaller diameter relative to an initial diameter and only after release be deflectable to a larger diameter relative to the initial diameter.

8. The ring as claimed in claim 1, wherein the ring is configured to flexibly be deflectable to a larger diameter relative to an initial diameter and only after release be deflectable to a smaller diameter relative to the initial diameter.

9. A borehole system, comprising:

a borehole in a subsurface formation;

a string in the borehole; and a retaining ring as claimed in claim 1, disposed within or as a part of the string.

10. A collet release configuration comprising:

a collet having a shoulder thereon;

a retaining ring comprising, a body;

a first end extending from the body, and a second end extending from the body, the second end engageable with the first end and releasable from the first end at a threshold energy input disposed radially adjacent the collet; and a sleeve actuable by movement of the collet only with the ring unreleased.

11. A method for actuating a tool, comprising:

deflecting a collet;

loading a retaining ring comprising:

a body;

a first end extending from the body; and a second end extending from the body, the second end engageable with the first end and releasable from the first end at a threshold energy input with the collet against a structure of the tool;

actuating the tool with the ring;

releasing the ring; and deflecting the collet.

12. The method as claimed in claim 11, wherein the releasing includes achieving a threshold load on the ring.

13. The method as claimed in claim 12, wherein the releasing includes shearing a flange.

14. The method as claimed in claim 11, wherein after the releasing the method includes changing a diameter of the ring.

15. The method as claimed in claim 11, wherein the method further includes disposing the ring radially adjacent the collet by deflecting the ring to a smaller diameter if the ring is to be radially inwardly disposed of the collet and deflecting the ring radially outwardly if the ring is to be radially outwardly disposed of the collet.

* * * * *